US010830260B2

(12) United States Patent
Pettenazzi et al.

(10) Patent No.: US 10,830,260 B2
(45) Date of Patent: Nov. 10, 2020

(54) LOCKABLE LINEAR ACTUATOR WITH A LOCKING INDICATOR

(71) Applicant: SAFRAN LANDING SYSTEMS, Velizy Villacoublay (FR)

(72) Inventors: Christelle Pettenazzi, Moissy-Cramayel (FR); Laurent Monsaint, Moissy-Cramayel (FR)

(73) Assignee: SAFRAN LANDING SYSTEMS, Valizy Villacoublay (FR)

( * ) Notice: Subject to any disclaimer, the term of this patent is extended or adjusted under 35 U.S.C. 154(b) by 0 days.

(21) Appl. No.: 16/543,052

(22) Filed: Aug. 16, 2019

(65) Prior Publication Data

US 2020/0056637 A1 Feb. 20, 2020

(30) Foreign Application Priority Data

Aug. 17, 2018 (FR) ..... 18 57529

(51) Int. Cl.
*F15B 15/26* (2006.01)
*F15B 19/00* (2006.01)

(52) U.S. Cl.
CPC ..... *F15B 19/005* (2013.01); *F15B 15/261* (2013.01)

(58) Field of Classification Search
CPC .. F15B 15/261; F15B 19/005; F15B 2211/72; F15B 2211/87
See application file for complete search history.

(56) References Cited

U.S. PATENT DOCUMENTS 2,702,024 A 2/1955 Harold
3,359,862 A * 12/1967 Modrich ..... F15B 15/261 91/42
4,887,944 A 12/1989 Worby et al.

FOREIGN PATENT DOCUMENTS

CN 2758546 Y 2/2006
EP 2 300 319 B1 11/2012

* cited by examiner

*Primary Examiner* — F Daniel Lopez
(74) *Attorney, Agent, or Firm* — Sughrue Mion, PLLC

(57) ABSTRACT

A telescopic actuator comprising a cylinder (2) in which a rod (3) is mounted to slide along a sliding axis (X), the actuator including a locking member comprising a locking finger (10) that is movable along a locking direction (Y) that is perpendicular to the sliding axis, between a locking position in which an end (9) of the locking finger (10) is engaged in a groove (8) of the rod in order to lock the rod in position, and a retracted position in which the end of the finger is disengaged from the groove in order to release the rod, a locking indicator (20) being secured to the locking finger to be movable between a position indicating locking when the locking finger is in the locking position, and a position indicating unlocking when the locking finger is in the retracted position, the actuator being characterized in that the locking indicator is secured to the locking finger by a connection (22, 23, 24) suitable for being interrupted in the event of the end of the finger being broken off while the rod is locked, a thrust spring (25) being arranged in the locking finger to push the locking indicator towards the position indicating unlocking when said connection is interrupted.

4 Claims, 8 Drawing Sheets

LOCKABLE LINEAR ACTUATOR WITH A LOCKING INDICATOR

The invention relates to a telescopic lockable actuator with a locking indicator.

BACKGROUND OF THE INVENTION

Telescopic actuators are known, e.g. hydraulic actuators, that comprise a cylinder in which a rod is mounted to slide along a sliding axis, and that include a locking member to lock the rod to the cylinder automatically when the rod reaches one of its extreme positions.

Various types of locking member exist, including locks making use of claws, of segments, or indeed of a finger. When making use of a finger, the finger is mounted on the cylinder to move along a locking axis that is perpendicular to the sliding axis, between a locking position towards which it is urged by a spring in order to penetrate into a groove in the rod, and a retracted position into which it is urged against the spring by the fluid under pressure admitted into the chamber of the actuator into which the finger penetrates. A sleeve is mounted on the cylinder to move along the sliding axis, between a retracted position, into which it is pushed by the rod when the rod approaches the locking position, and a position for holding the finger in the retracted position, into which the sleeve is pushed by a spring in order to move under the finger that has been retracted by the fluid under pressure.

It is known to fit the finger with an indicator or with some other detector device in order to show the position in which the finger is to be found, and thus indicate whether the rod is locked or unlocked. Nevertheless, when the rod is locked, it can happen that the actuator rod is subjected to a force such that the end of the finger is broken off. The rod then appears to be locked even though the broken finger cannot hold the rod in position.

OBJECT OF THE INVENTION

The invention seeks to provide a linear actuator that is lockable by means of a finger, and in which the indicator member serves to detect non-locking, even if the finger appears to be in the locking position.

SUMMARY OF THE INVENTION

In order to achieve this object, there is provided a telescopic actuator comprising a cylinder in which a rod is mounted to slide along a sliding axis, the actuator including a locking member comprising a locking finger that is movable along a locking direction that is perpendicular to the sliding axis, between a locking position in which an end of the locking finger is engaged in a groove in the rod in order to lock the rod in position, and a retracted position in which the end of the finger is disengaged from the groove in order to release the rod, a locking indicator being secured to the locking finger to be movable between a position indicating locking when the locking finger is in the locking position, and a position indicating unlocking when the locking finger is in the retracted position. According to the invention, the locking indicator is secured to the locking finger by a connection suitable for being interrupted in the event of the end of the finger being broken off while the rod is locked, a thrust spring being arranged in the locking finger to push the locking indicator towards the position indicating unlocking when said connection is interrupted.

Thus, the locking indicator provides information that is reliable, even if the finger is broken, by occupying its position indicating unlocking even while the end of the finger has been broken off and the locking finger remains in its locking position.

In a preferred embodiment of the invention, the indicator is associated with a frangible support that extends in a bore in the locking finger in order to be connected to its end. Thus, breaking off the end causes the frangible support to break, thereby disconnecting the locking indicator, which can then be moved by the thrust spring.

DESCRIPTION OF THE FIGURES

The invention can be better understood in the light of the following description of a particular embodiment of the invention, given with reference to the figures of the accompanying drawings, in which.

DETAILED DESCRIPTION OF THE INVENTION

Figures 1, 5:
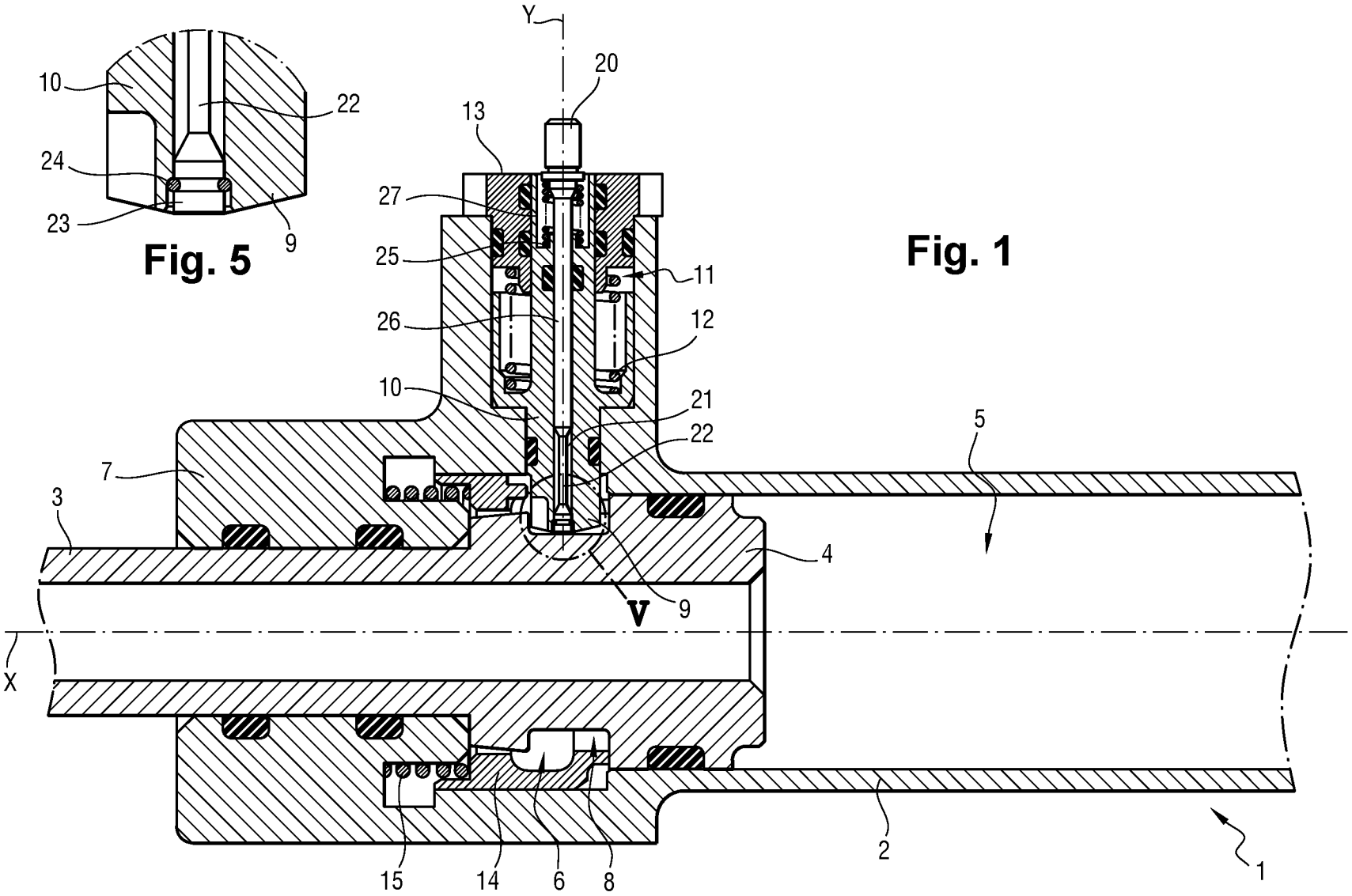
FIG. 1 is a section view of a lockable telescopic actuator in a particular embodiment of the invention, the rod of the actuator being shown in the locked position, the locking finger being shown in the locking position, and the indicator being shown in its position indicating locking.
FIG. 5 is a detail view on a larger scale of the connection between the locking indicator and the locking finger.

With reference to FIGS. 1 to 4, the invention applies to a telescopic actuator, specifically in this example to a hydraulic actuator 1 comprising a hollow cylinder 2 in which a rod 3 associated with a piston 4 is mounted to slide in sealed manner inside the cylinder 1 along a sliding axis X in order to define an uninterrupted (or "piston") chamber 5 extending between the piston 4 and an uninterrupted end wall of the cylinder (not shown), and an annular chamber 6 extending between the piston 4 and a pierced (i.e. "interrupted") end wall 7 through which the rod 3 projects.

Figure 2:
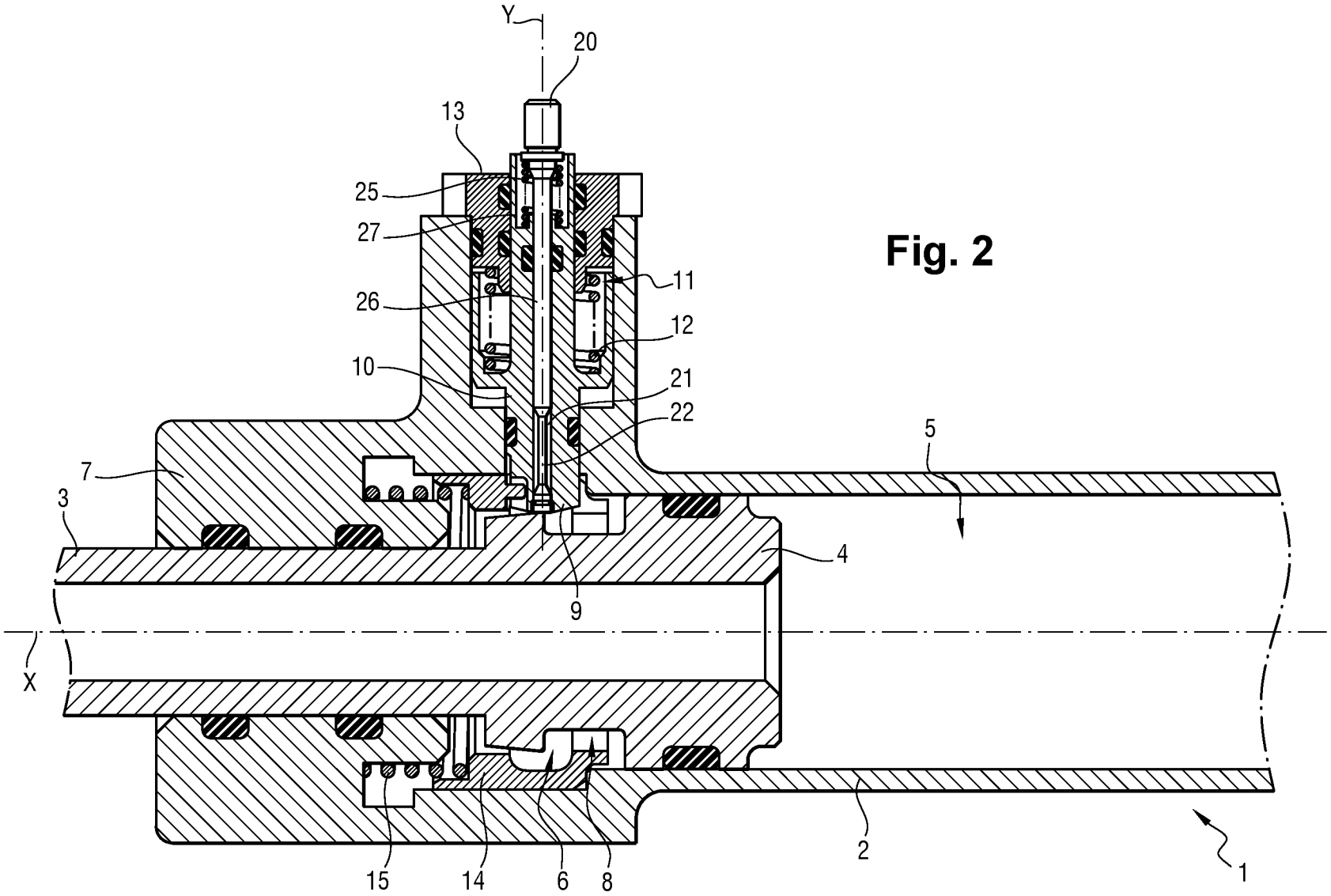
FIG. 2 is a view analogous to the view of FIG. 1, the rod being in the process of being unlocked, the finger being pushed into the retracted position, and the indicator being in its position indicating unlocking.
Figure 3:
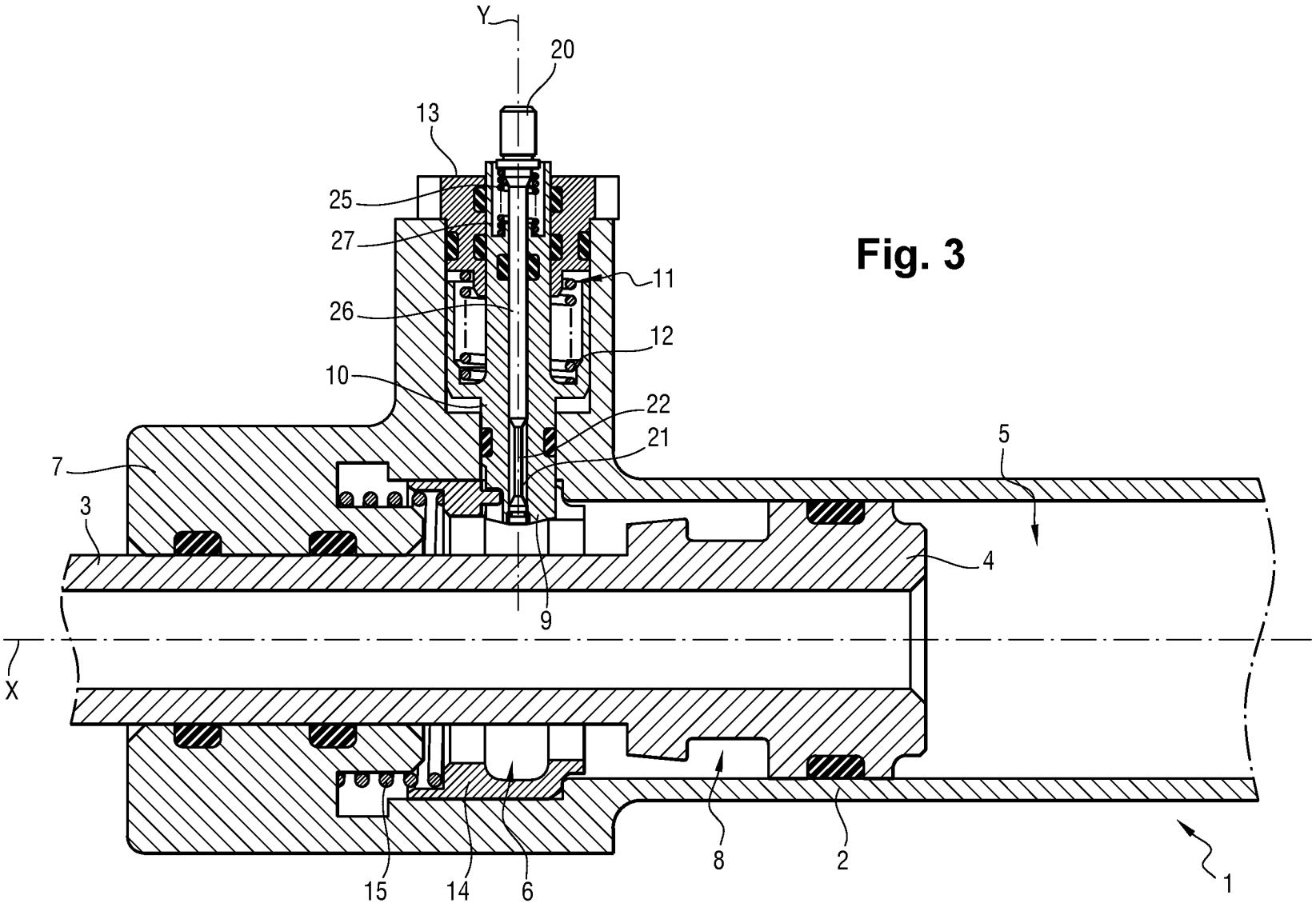
FIG. 3 is a view analogous to the view of FIG. 2, the rod being unlocked and the finger being blocked in the retracted position, the indicator being in its position indicating unlocking.

The piston 4 includes a groove 8 for receiving the end 9 of a locking finger 10 mounted to slide in sealed manner along a locking axis Y perpendicular to the sliding axis X in a housing 11 of the cylinder 1, between a locking position as shown in FIG. 1, in which the end 9 is engaged in the groove 8 in order to block the rod 3 in the extended position, and a retracted position, as shown in FIGS. 2 and 3, in which the end 9 is disengaged from the groove 8, thereby releasing the rod 3.

The locking finger 10 is urged towards the locking position by a locking spring 12 bearing against a plug 13 that closes the housing 11. The locking finger 10 is pushed into the retracted position when fluid under pressure is admitted into the annular chamber 6. A sleeve 14 is arranged in the cylinder 1 to slide along the sliding axis X, between a retracted position towards which it is pushed by the piston 4 against a return spring 15 when the rod 3 is in the locked position, as shown in FIG. 1, and a blocking position, as shown in FIG. 3, into which the sleeve 14 is pushed by the return spring 15 when the locking finger 10 is in the retracted position, in order to keep it there and block it in this position even if the annular chamber 6 is no longer under pressure.

As shown in FIG. 1, the locking finger 10 is associated with a locking indicator 20 that projects from the plug 13 in order to be visible from the outside. The locking indicator 20 is secured to a rod 26 engaged in a central bore 21 in the locking finger 10. As can be seen more particularly in FIG. 5, the rod 26 is extended by a frangible support 22 of smaller section that is terminated by a foot 23 that is secured to the locking finger 10 at its end 9 by a retaining ring 24. A thrust spring 25 extends around the rod 26 in a housing 27 of the locking finger 10, bearing against an end wall of the housing 27 and against a shoulder of the indicator 10 in order to push the indicator 20 outwards. In the situation shown, the retaining ring 24 retains the locking indicator 20 against the thrust spring 25.

There follows a description of the operation of the assembly. In the situation shown in FIG. 1, the end 9 of the locking finger 10 is engaged in the groove 8 of the piston 4, thereby locking the rod 3 in position (specifically in the extended position). The locking spring 12 holds the locking finger in the locking position. The locking indicator 20 is in its position indicating locking.

Admitting fluid under pressure into the annular chamber 6 causes the locking finger 10 to move towards its retracted position, as shown in FIG. 2, thereby releasing the rod 3. The locking indicator 20 is in its position indicating unlocking.

Released in this way, the rod 3 can move in the cylinder 2, thereby having the effect of enabling the sleeve 14 to move towards the blocking position under drive from the return spring 15 in order to hold the locking finger 10 in the retracted position, as shown in FIG. 3. The locking indicator 20 is thus held in its position indicating unlocking.

Thereafter, when the fluid under pressure is admitted into the uninterrupted chamber 5, the rod 3 returns towards its extended position, until it pushes the sleeve 14 back against the spring 15 thereby enabling the end 9 of the locking finger 10 to penetrate into the groove 8 under the action of the locking spring 12 in order to lock the rod 3. The locking indicator 20 returns to its position indicating locking.

Figure 4:
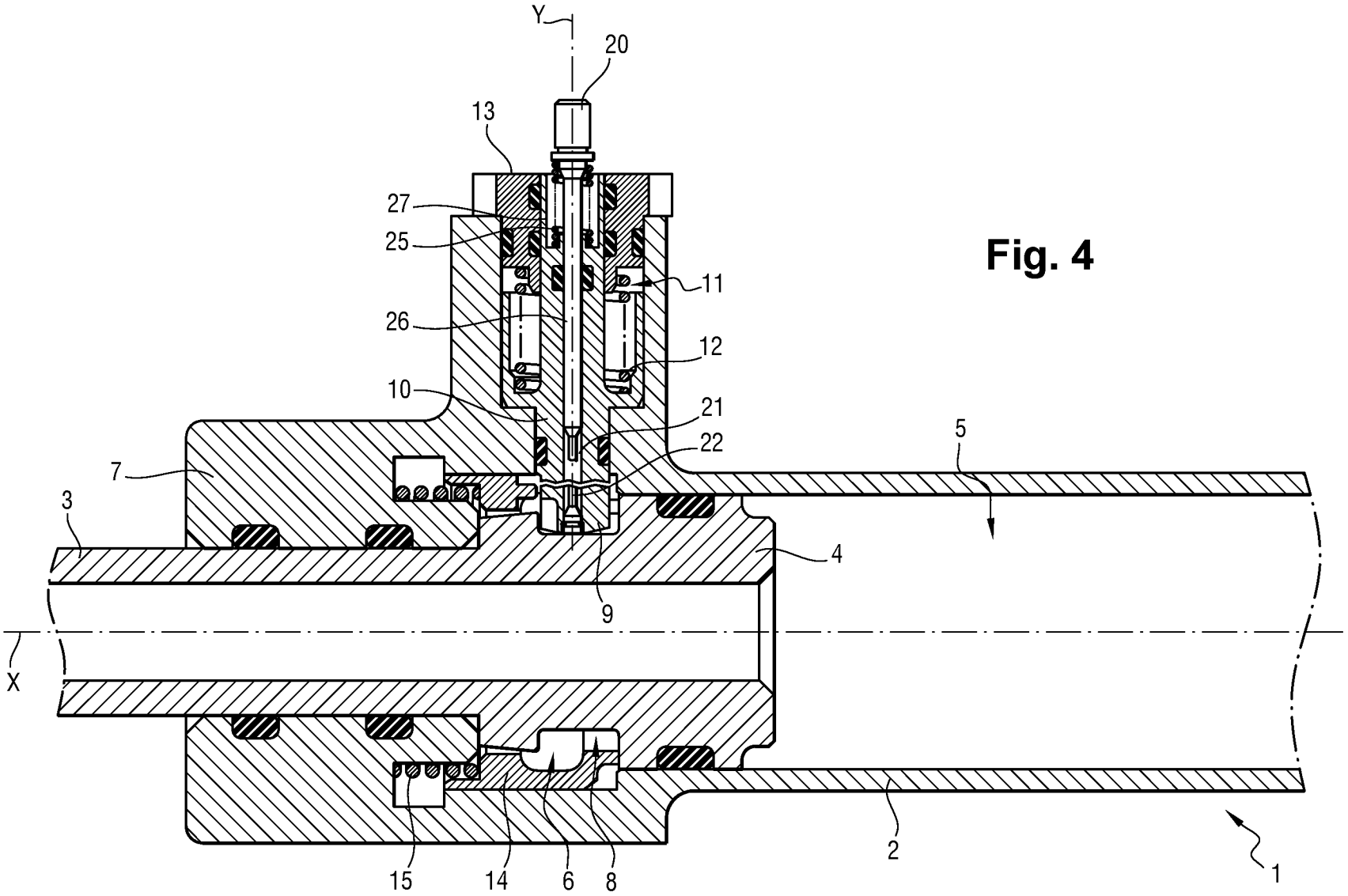
FIG. 4 is a view analogous to the view of FIG. 1, the finger being in the locking position, but with the end of the locking finger being broken by the rod, and with the indicator being pushed into its position indicating unlocking.

Under certain circumstances, the load coupled to the rod can exert a large force on the rod 3 while the rod 3 is in the locked position. Under certain exceptional circumstances, the force is so large that it causes the locking finger 10 to break by severing its end 9. The rod 3 is thus released, even though the locking finger 10 remains in the locked position, as shown in FIG. 4.

Nevertheless, breaking the end 9 of the locking finger 10 causes the frangible support 21 to break simultaneously, so that the connection between the locking indicator 20 and the locking finger 10 is interrupted. The locking indicator 20 is thus released and is pushed towards its position indicating unlocking by the trust spring 25, even though the locking finger 10 remains in the locked position. This provision serves to avoid the locking indicator providing an indication of locking when, in practice, the rod 3 is in fact released.

Figure 6:
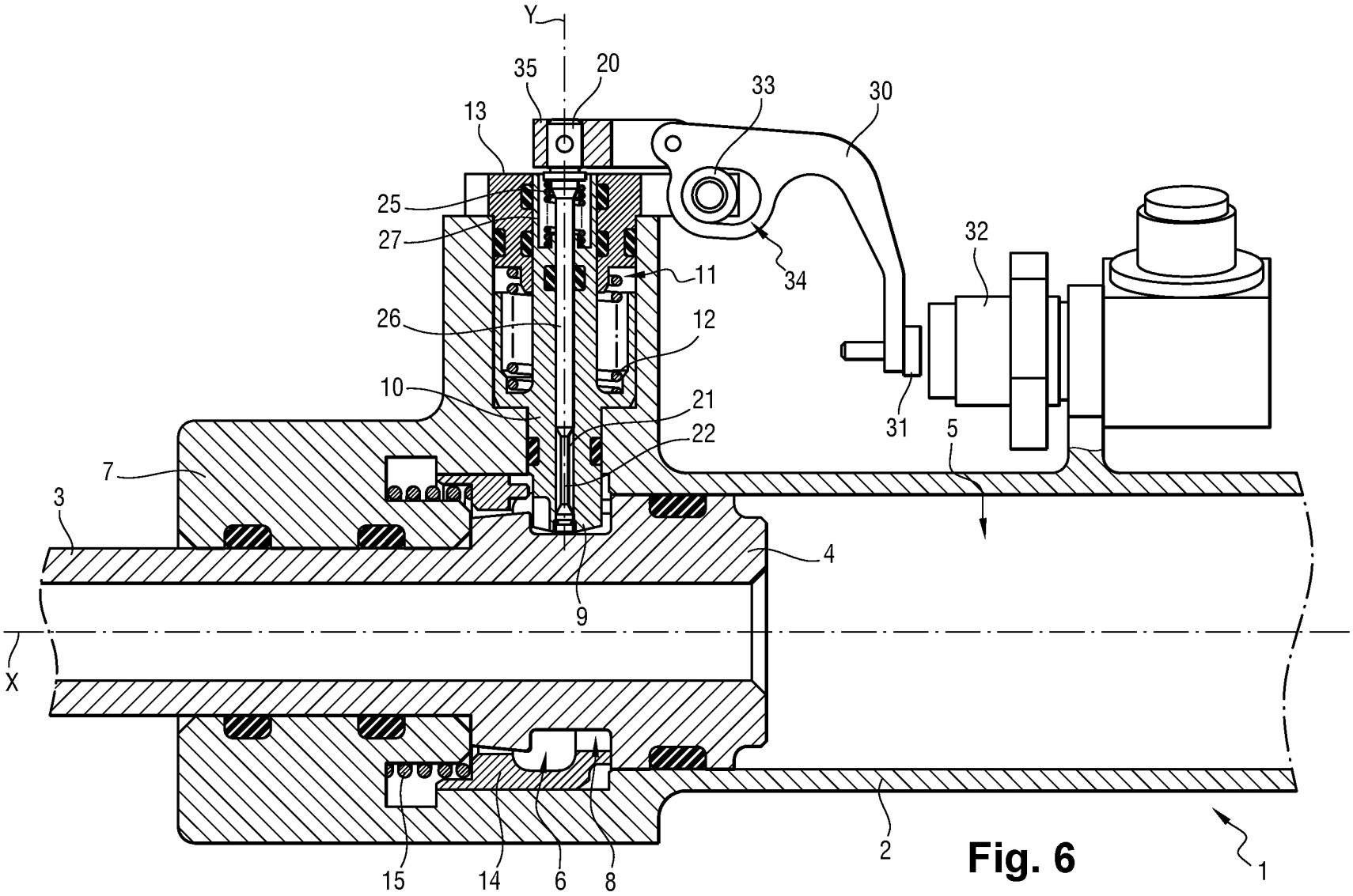
FIGS. 6 to 9 are figures similar to FIGS. 1 to 4 showing a variant embodiment of the invention.
Figure 7:
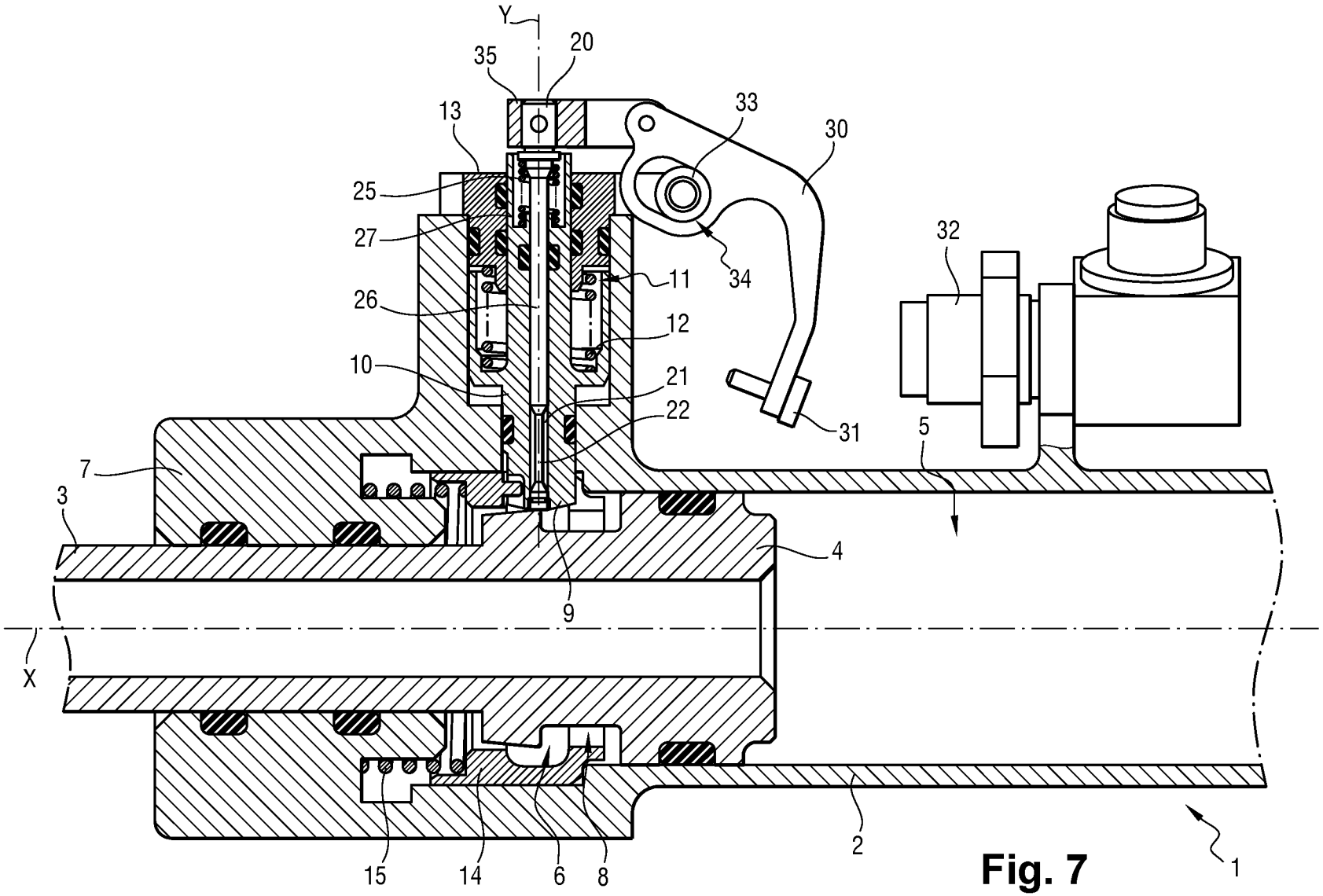
Figure 8:
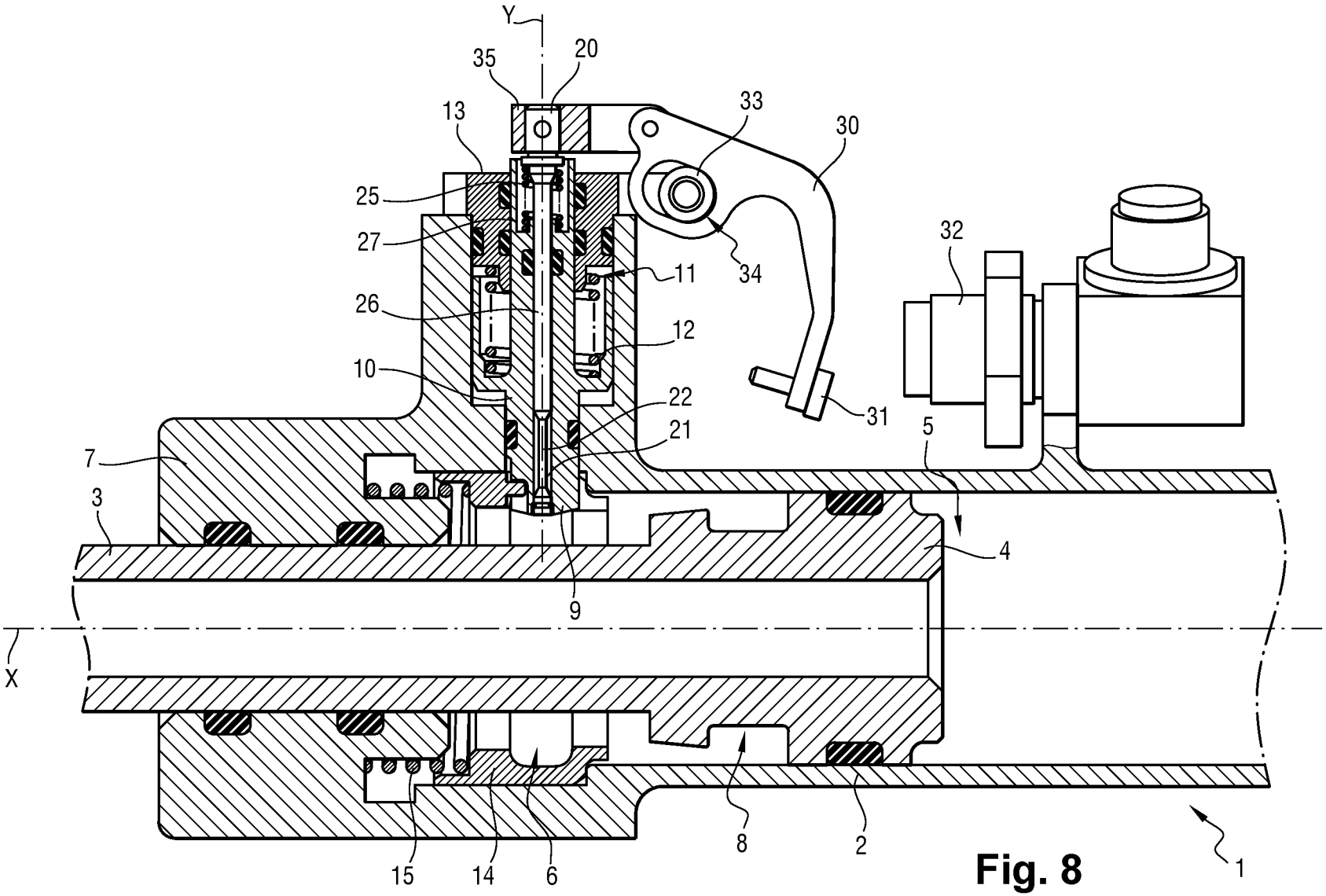
Figure 9:
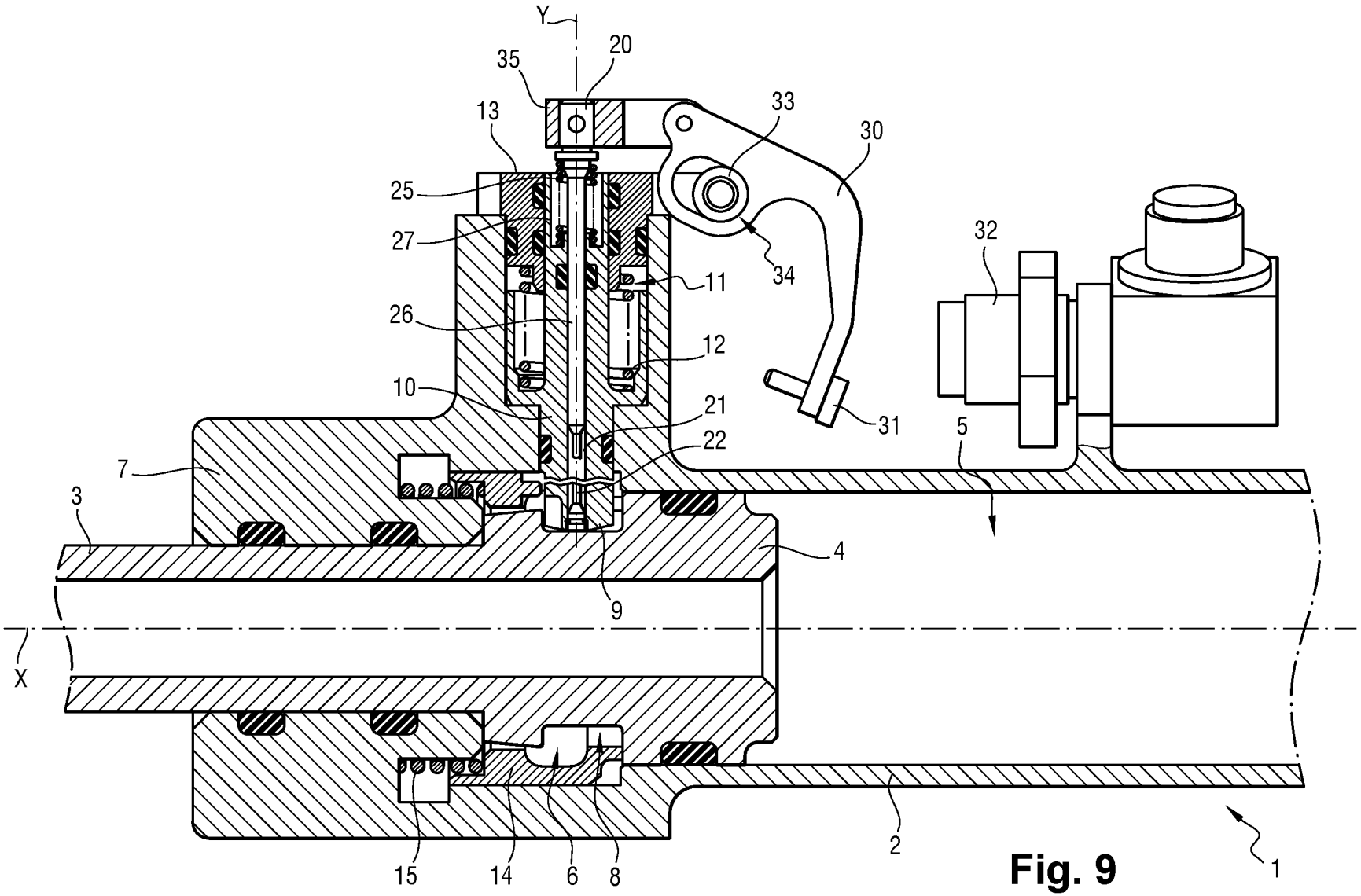

Instead of a visual indication, it can be advantageous to detect the positions of the locking indicator by means of a detector that is adapted to generate an electrical signal that takes two distinct values. In the variant of the invention shown in FIGS. 6 to 9, in which common elements are given the same references as in FIGS. 1 to 4, the locking indicator 20 is used to actuate a crank 30 carrying a target 31 that faces a detector 32, and that moves between a position close to the detector 32, as shown in FIG. 6, corresponding to the position indicating locking, and a position remote from the detector 32, as shown in FIGS. 7 to 9, corresponding to the position indicating unlocking, such that the detector 32 generates an electrical signal that takes two distinct values, thereby making it possible to distinguish between the two indicated positions. In this example, the crank 30 is hinged to a pivot 33 that is secured to the plug 13 and that extends through an oblong opening 34 in the crank 30. The crank 30 is also hinged to a collar 35 that is clamped directly onto the outer end of the locking indicator 20. Thus, movement of the locking indicator 20 causes the crank 30 to pivot, thereby moving the target 31 between its two positions that are respectively close to and remote from the detector 32.

The invention is not limited to the above description, but on the contrary covers any variant coming within the ambit defined by the claims.

The invention claimed is:

1. A telescopic actuator comprising a cylinder (2) in which a rod (3) is mounted to slide along a sliding axis (X), the actuator including a locking member comprising a locking finger (10) that is movable along a locking direction (Y) that is perpendicular to the sliding axis, between a locking position in which an end (9) of the locking finger (10) is engaged in a groove (8) in the rod in order to lock the rod in position, and a retracted position in which the end of the finger is disengaged from the groove in order to release the rod, a locking indicator (20) being secured to the locking finger to be movable between a position indicating locking when the locking finger is in the locking position, and a position indicating unlocking when the locking finger is in the retracted position, the actuator being characterized in that the locking indicator is secured to the locking finger by a connection (22, 23, 24) suitable for being interrupted in the event of the end of the finger being broken off while the rod is locked, a thrust spring (25) being arranged in the locking finger to push the locking indicator towards the position indicating unlocking when said connection is interrupted, while the locking finger remains in the locking position.

2. An actuator according to claim 1, wherein the locking indicator is engaged in a bore (21) of the locking finger (9) and is secured to a frangible support (22) terminated by a foot (23) that is connected to the end of the locking finger by a retaining ring (24).

3. An actuator according to claim 1, fitted with a detector (32) for generating a signal that takes two values depending on whether a target (31) connected to the locking indicator is close to or remote from the detector.

4. An actuator according to claim 3, wherein the target is carried by a crank (30) hinged to the cylinder of the actuator and connected to the locking indicator.

* * * * *